US006142227A

United States Patent [19]

Hiorth et al.

[11] Patent Number: 6,142,227

[45] Date of Patent: Nov. 7, 2000

[54] EXPANDABLE RETRIEVABLE BRIDGE PLUG

[75] Inventors: Epen Hiorth; Frode Andersen; Dag Ravn Pedersen, all of Trondheim, Norway

[73] Assignees: Brönnteknologiutvikling AS, Trondheim; Maritime Well Service AS, Forus, both of Norway

[21] Appl. No.: 09/029,325

[22] PCT Filed: Aug. 15, 1996

[86] PCT No.: PCT/NO96/00207

§ 371 Date: Mar. 3, 1998

§ 102(e) Date: Mar. 3, 1998

[87] PCT Pub. No.: WO97/09512

PCT Pub. Date: Mar. 13, 1997

[30] Foreign Application Priority Data

Sep. 8, 1995 [NO] Norway ..... 953546

[51] Int. Cl.[7] ..... E21B 33/128; E21B 33/129

[52] U.S. Cl. ..... 166/123; 166/134; 166/135; 166/138; 166/182; 277/340

[58] Field of Search ..... 166/123, 127, 166/134, 135, 138, 182, 191, 192, 387; 277/337, 338, 339, 340, 341

[56] References Cited

U.S. PATENT DOCUMENTS

| | | | |
|---|---|---|---|
| 2,612,953 | 10/1952 | Morgan et al. | 277/340 |
| 3,057,406 | 10/1962 | Patterson et al. | 166/120 |
| 3,097,696 | 7/1963 | Orr | 166/135 |
| 3,570,596 | 3/1971 | Young | 166/129 |
| 3,666,010 | 5/1972 | Harris | 166/134 |
| 3,776,561 | 12/1973 | Haney | 277/340 |
| 4,284,137 | 8/1981 | Taylor | 166/137 |
| 5,701,959 | 12/1997 | Hushbeck et al. | 166/387 |

*Primary Examiner*—George Suchfield
*Attorney, Agent, or Firm*—Alix, Yale & Ristas, LLP

[57] ABSTRACT

A bridge plug (1) for use in a casing (7), for example in oil and/or gas wells, comprising a packing element (2) of a resilient material is disclosed. The packing element (2) is adapted for at impact from a running tool to expand from a first diameter, to a second diameter that is greater than the first diameter which corresponds to the inner diameter of the casing that is to be sealed. The packing element (2) is divided in zones forming at least one expandable sealing packing element (34, 35) and at least one expandable support packing element (31, 32, 33), where the support packing elements (31, 32, 33) are expandable to a smaller diameter than the sealing packing elements (34, 35). The bridge plug (1) is further comprised of an anchoring means (3) that is provided for holding the bridge plug (1) in its place in the casing by a friction surface (28) that is pressed radially against the casing (7).

18 Claims, 6 Drawing Sheets

EXPANDABLE RETRIEVABLE BRIDGE PLUG

CROSS-REFERENCE TO RELATED APPLICATIONS

This is the national stage of International Application No. PCT/NO96/00207 filed Aug. 15, 1996.

BACKGROUND OF THE INVENTION

The invention concerns a retrievable bridge plug.

In many situations it is necessary to isolate one or more zones in cased well. As an example, it may be necessary to isolate against fluid and pressure in an oil or gas well. In this situation, a bridge plug can be used to isolate against changes in pressure in both directions.

Such bridge plugs comprises in principle a sealing part for sealing the differential pressure, and an anchoring part for preventing movement of the bridge plug due to the pressure force. In oil and gas wells, the bridge plug will in many circumstances have to pass constrictions, for example valves and nipples (hereafter called "restrictions"), after which it becomes located in a wider casing diameter. Due to their constructions, known retrievable bridge plugs have a limitation in the expansion, which prevents use of bridge plugs in some oil and gas wells.

Known bridge plugs exist in many dimensions, adapted to the different casing dimensions where the plug is to be placed. This follows from the fact that conventional bridge plugs have a comparatively low expansion rate. The low expansion rate of conventional bridge plugs is partly due to the construction of the anchoring part, and partly due to the structure of the packing element. A common method for anchoring plugs has been to use conical slip segments which are forced out radially, between two conical pipes which are forced together axially. In this method, the expansion of the slip segments is limited by the outer diameter of the conical pipes. Without active pulling of the slip segments, they can become stuck in restrictions when being pulled out of the oil or gas well. The packing element expands when a rubber body is squeezed axially. At high pressure and great expansion, existing packing elements can creep after some time, which eventually will result in leakage over the packing element. When pulling existing bridge plugs, the elasticity of the rubber will see the packing element return to the shape it had before setting. Without active pulling of the packing element, a deformed packing element may lead to difficulties in pulling the bridge plug out of the well, because it can become stuck in restrictions.

SUMMARY OF THE INVENTION

It is thus an object of the invention to provide a retrievable bridge plug which has a high expansion rate, may be anchored in a secure way in the well, and cover an expansion area which until now has demanded a number of bridge plugs with different setting diameter.

BRIEF DESCRIPTION OF THE DRAWINGS

In the following, the invention will be described further by means of examples of embodiments and with reference to enclosed drawings, where.

DETAILED DESCRIPTION OF THE PREFERRED EMBODIMENT

Figure 1:
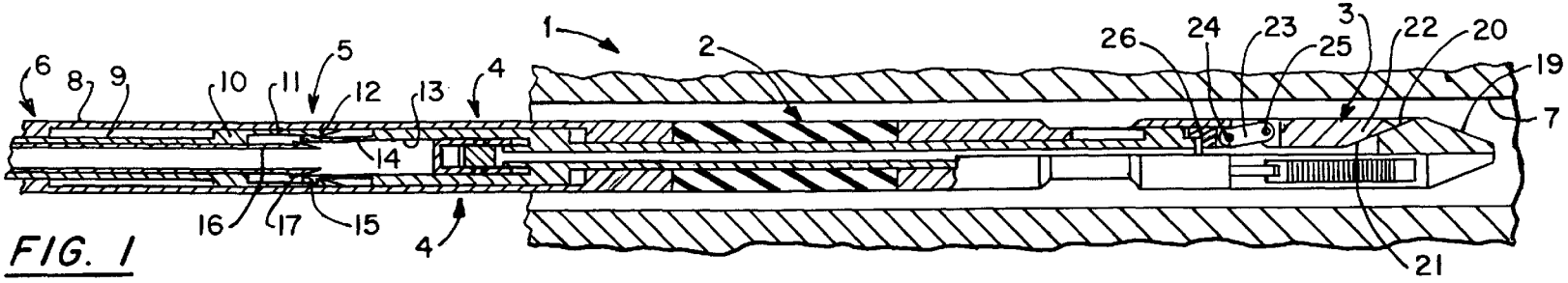
FIG. 1 shows a partly axially sectioned bridge plug according to the present invention, during entrance in a cased well.

FIG. 1 shows a bridge plug 1 according to the invention, before setting in the casing. The bridge plug 1 is comprised of the main elements packing element 2, anchoring means 3, equalizing valve 4, finger connection 5 and locking means 6. The bridge plug 1 is arranged to be brought into and anchored in for example, a casing 7. The bridge plug 1 comprise a tubular outer sleeve 8, forming the outer delimitation of the bridge plug. In the back end of the bridge plug (to the left of FIG. 1), there is provided within the outer sleeve 8 a tubular downhaul tube 9 with an outer diameter that is somewhat smaller then the inner diameter of the outer sleeve 8, so that a gap is formed therebetween. Through a thicker section 10, the downhaul tube 9 forms a section 11, having an external diameter corresponding to the inner diameter of the outer sleeve 8. At the end of the section 11 is provided an inward flange 12. This flange enganges an outward flange 15, forming the end of a section 14 of a tubular package mandrel 13. The flange 15 and the section 14 are split axially, so that radial movement is possible. Between the section 14 and outer sleeve 8 is formed a gap corresponding to the thickness of the flange 12. Inside the flange 15 is a further flange 17, forming the end of a cut-off tube 16. The flange 17 has further a section supporting the end of the flange 15. The sections 11 and 14 with their flanges 12 and 15 together form the finger connection 5, preventing cut-off by means of the support from the section of the flange 17.

Figure 2:
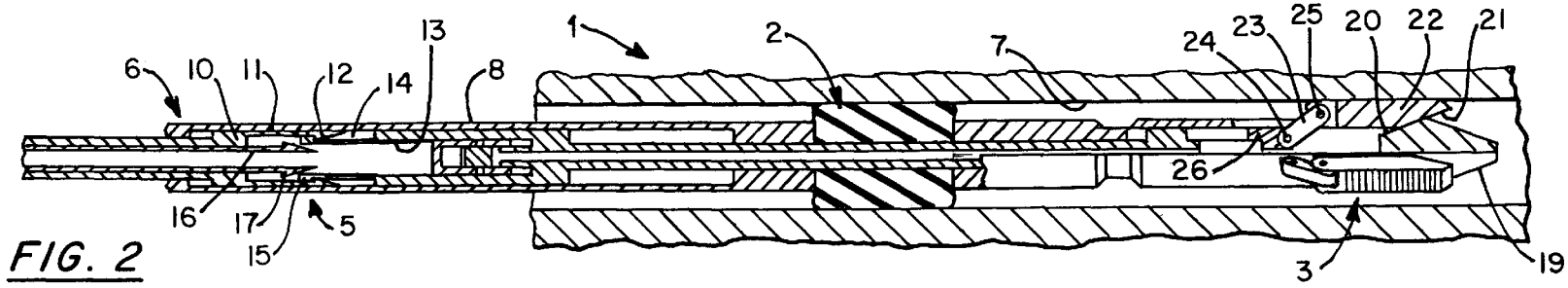
FIG. 2 shows the partly axially sectioned bridge plug from FIG. 1, in expanded and anchored condition.

FIG. 2 shows the bridge plug 1 during insertion in the casing. Outer sleeve 8 is moved relative to the downhaul tube 9, the cut-off tube 16 and the package mandrel 13, by means of a suitable running tool (not shown). The running tool excerts a force F1 between the outer sleeve 8 and the package mandrel 13. This involes the slip segments 22 of the anchoring means 3 being expanded and forced onto the casing wall. This will be further explained below. Movement of the outer sleeve 8 will continue even though the attached anchoring means will lead to the packing element 2 being squeezed axially, so that it expands out against the tube. When the packing element 2 is compressed sufficiently, so that it can seal against the differential pressure, the end clamps on each side of the packing element 2 will work against each other. This enables the anchoring means to be biased against the casing wall with a desired force, without the necessity of transferring this force through the elastomer in packing element 2. When the movement is finished and the bridge plug 1 is set with the desired force, the running tool is released. The locking means 6 ensures that the packing element 2 and the slip segments 22 are kept expanded by the pressure load from one of the sides.

Figure 3:
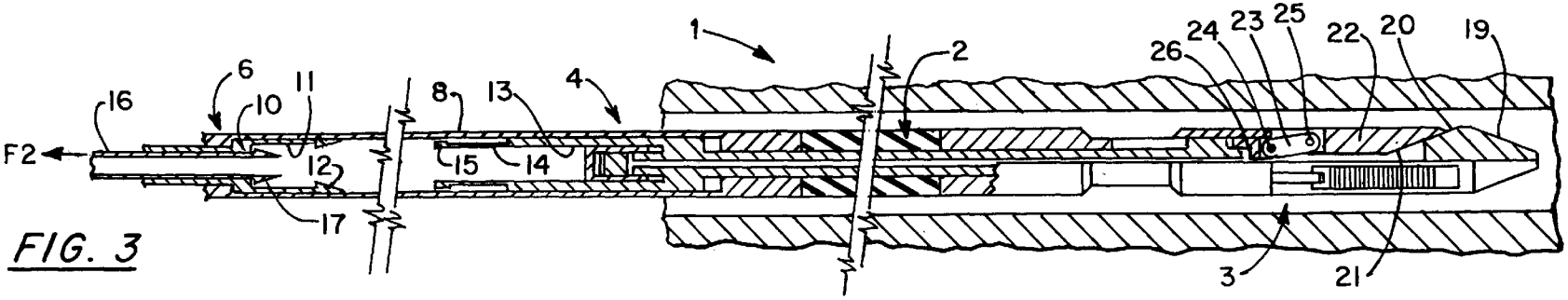
FIG. 3 shows the partly axially sectioned bridge plug of FIG. 1, drawn down and detached, ready for retrieving out of the cased well.
Figure 4:
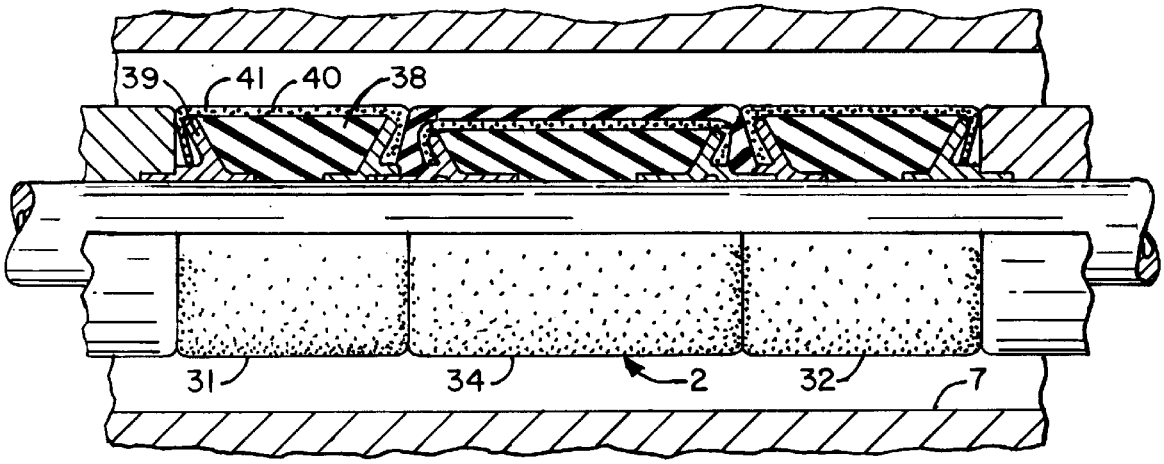
FIG. 4 shows an axial half sectioned packing element of the bridge plug of FIG. 1, in a down-drawn condition.
Figure 9:
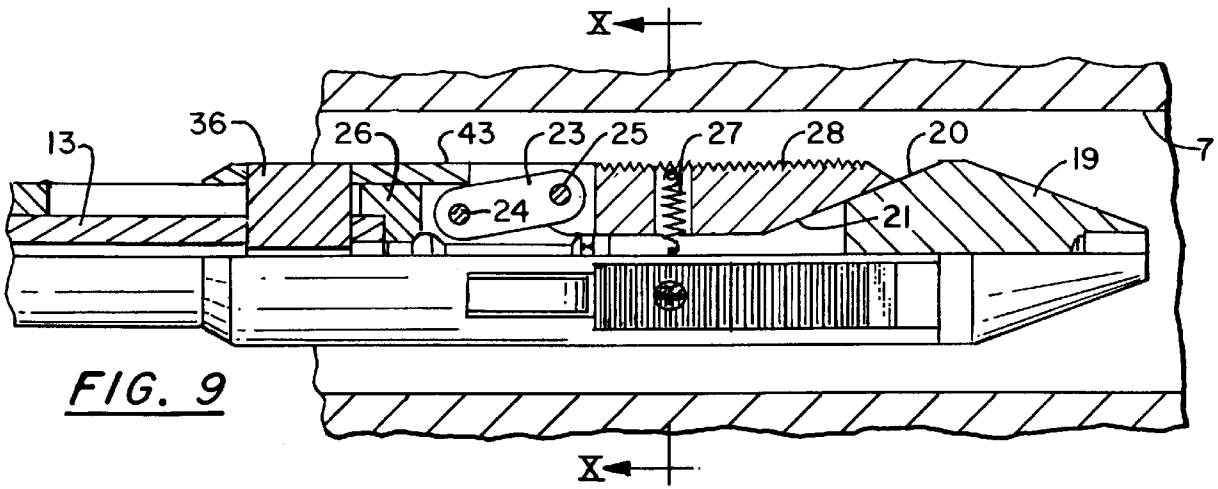
FIG. 9 shows a half section of the front part of the bridge plug of FIG. 1, where the slip segments of the anchoring means are drawn down.

When the bridge plug 1 is drawn down, the following movement pattern occurs. A dedicated retrieval tool (not shown) is connected on the back of the bridge plug 1 and is drawn with a force F2 as shown in FIG. 3. The cut-off tube 16 is then moved relative to the package mandrel 13. In this movement, the support under the flange 15 disappears. When the cut-off tube 16 is moved further, the flange 17 will hook up with the section 10, and the finger connection 5 will release. The cut-off tube 16 and the downhaul tube 9 will move further together relative to the outer sleeve 8, while the package mandrel 13 is stationary. Afterwards the section 10 will hook up with outer sleeve 8, which will then draw the packing element 2 down while the anchoring means 3 holds the bridge plug 1 relative to the casing wall 7. After the packing element 2 is drawn down, the anchoring means 3 will be released from the casing wall 7. The bridge plug 1 is then loose and can be drawn out of the cased well. In addition to the elasticity of the packing element, the weight of the released part of the plug will draw the packing element to its original diameter. Return springs 27 as shown in FIG. 9 and the weight of the released part of the plug provide the slip segments 22 to be drawn in to the anchoring means. The bridge plug is then loose and can be drawn out of the cased well.

When pulling the plug out of, for example, an oil or gas well, the plug will meet restrictions on its way out of the well. If the package element, due to permanent deformation, has a greater diameter than a restriction, the plug can still be drawn through the restriction, because the reinforcement prevents the elastomer to become stuck in the cased well. The anchoring means is also formed so that the slip segments are drawn in to the plug if the slip segments hit a restriction. However, this can only occur if the slip segments do not go down by means of the return springs and the weight of the released part of the plug (see description of the anchoring means).

The equalizing valve 4 is situated within the tubular package mandrel 13. The equalizing valve 4 can be used for two purposes. When the bridge plug is to be drawn out, it is desirable to equalize the pressure on both sides of the packing element 2. This is done by the dedicated strut of the retrieval tool (not shown) being thrust into the circulation port 4, so that communication for fluid and pressure occurs between both sides of the packing element 2. Furthermore, if it is desired to circulate fluid through the bridge plug while it is set, it can be done by opening the circualtion port 4 with a dedicated opening tool (not shown).

Figure 6:
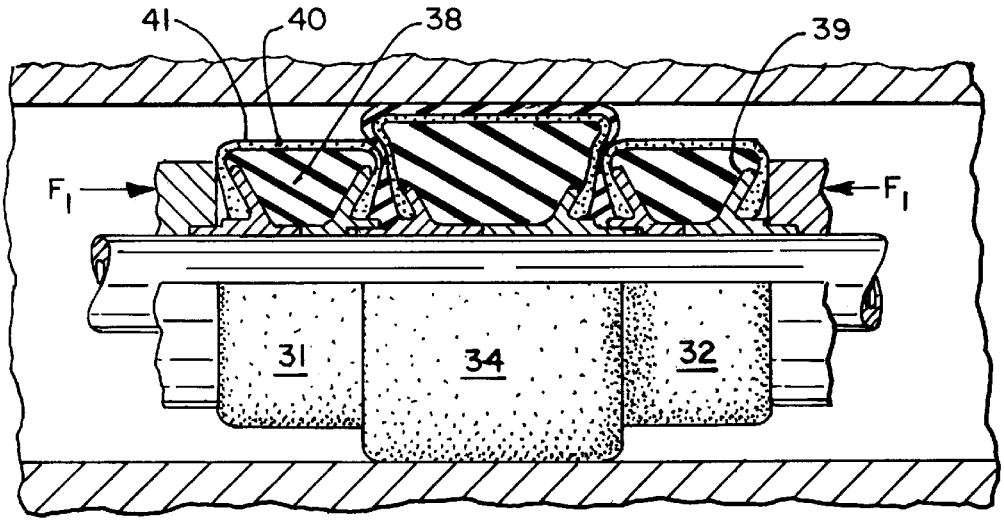
FIG. 6 shows the axial half sectioned packing element from FIG. 4, in expanded condition.
Figure 7:
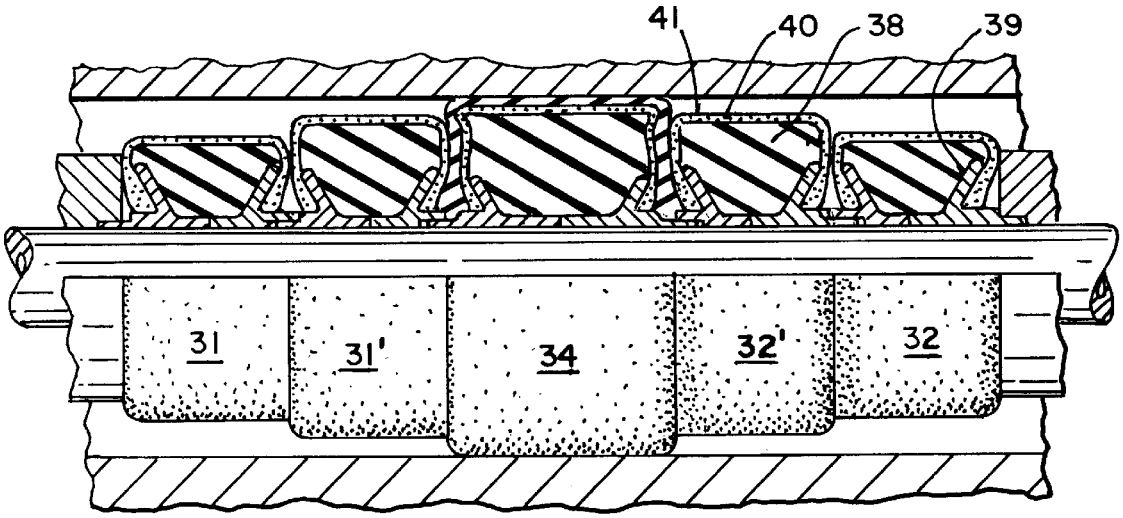
FIG. 7 shows an axial half sectioned packing element composed of a sealing packing element having two supporting packing elements on each side, where the supporting packing elements are expanded up to their expanded diameters.
Figure 8:
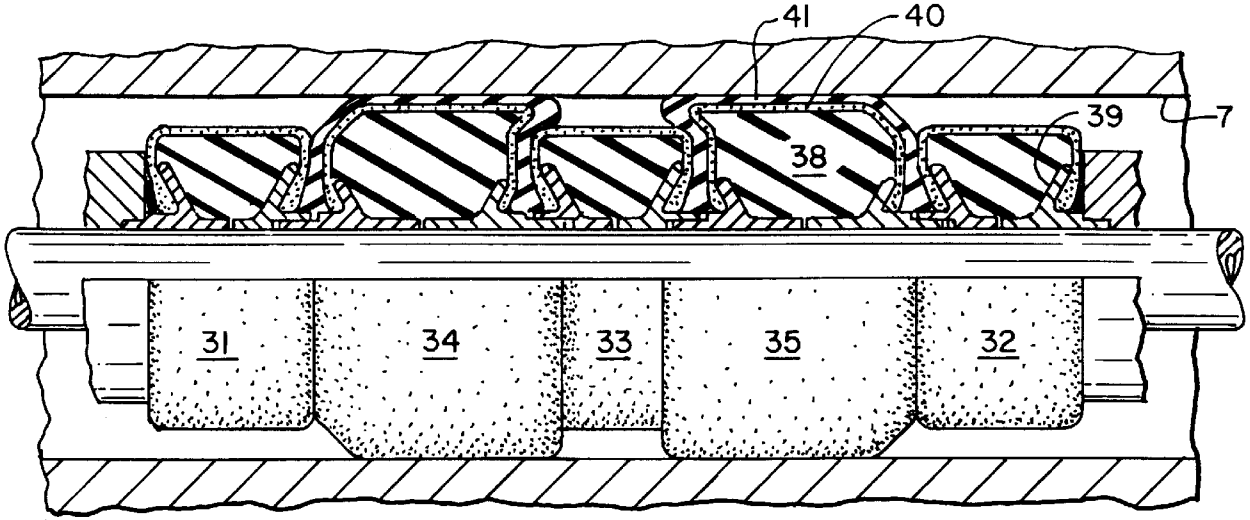
FIG. 8 shows an axial half section of a packing element comprising two sealing packing elements which have a common supporting point in the middle, and supporting packing elements on each side.

With reference to FIGS. 4–8, the packing element 2 will now be described in more detail. The packing element 2 is constructed from a number of supporting packing elements 31, 32, 33 and a number of sealing packing elements 34, 35 (FIG. 8). The different packing element parts are separate parts that can be mounted so that they together form a packing element.

The sealing packing element is isolated so that fluid and pressure in the cased well can not pass beyond this point after the sealing packing element is expanded against the casing wall 7. The function of the supporting packing elements is to prevent undesired movement of the sealing packing element during pressure influence, by minimizing the gap through which the sealing packing element can expand. The object of the supporting packing elements 31, 32, 33 is merely to reduce the gap between the bridge plug 1 and casing 7, so that the sealing packing elements 34, 35 are stable during pressure influence; also other types of expandable supports than reinforced elastomers may be used, such as steel lamellae, which are expanded by conical clamps 39, and held in place with a radial force against the center, through reinforcement threads 40. Depending upon pressure difference and gap height, the packing element can be constructed in a number of ways. Generally, this can be expressed so that by a combination of low pressure and small gap, the packing element is constructed from only one sealing packing element and no supporting packing elements. With high pressure and large gap, one or more supporting packing elements are used to give the necessary support to the sealing packing element, so that extrusion of the sealing packing element during some time, do not lead to leakage. In FIG. 6 is shown an embodiment comprising a sealing packing element 34 and two support packing elements 31, 32. In FIG. 7 is shown an embodiment with two support packing elements 31, 31'; 32, 32', having different diameters on each side of the sealing packing element 34, where the support packing elements 31, 32 nearest the clamp give support to the support packing element 31', 32', nearest the sealing packing element 34. In FIG. 8 is shown the prefered embodiment having two sealing packing elements 34, 35 and three support packing elements 31, 32, 33, where each support packing element will seal against fluid and pressure from each side. This prevents the sealing packing element to acquire an undesired deformation when the differential pressure rises and falls, respectively, on one of the sides relative to the other side.

The packing elements comprise an inner core 38 in a resilient material (e.g. rubber) located between two conical clamps 39. An expandable reinforcement bag formed from reinforcement threads 40 is situated over the core 38, and is attached to the clamps. Over the reinforccement, an outer layer 41 of the same material as the core 38 is moulded to the reinforcement bag and the core 38 (FIG. 6). At expansion, the reinforcement approaches self locking (blocking) at a predetermined diameter and compression length. The reinforcement of the packing element elements will function as a ductile container during expansion.

Figure 5:
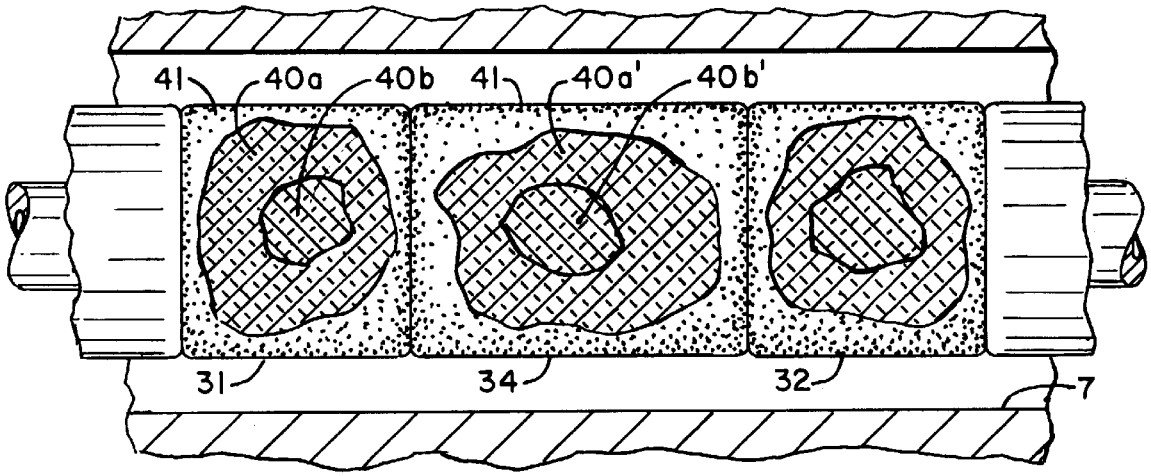
FIG. 5 shows a partly sectioned view of the packing element from FIG. 4, where cord layers from the different packing elements are depicted.

As shown in FIG. 5, the reinforcement is wound in different angles over the supporting packing element and sealing packing element. Two cord layers 40*a*, 40*b*; 40*a*', 40*b*' are provided, over both supporting packing element 31 and sealing packing element 34.

The compression length is given by the packing element clamps which apporach each other. This implies that the packing elements are not displaced at axial load, and an axial force F1 can be transferred directly through the packing element via the clamps, without this, the elastomer and reinforcement become overloaded. The axial force F1 can thus be used to position the slip segments out against the casing wall with a desired radial force. By drawing the packing element 2, the upper clamp 39 is pulled up against the top of the plug via outer sleeve 8, while the lower clamp is held back by the anchoring means 3 via displacement tube 26. Then an axial tension arises in the reinforcement threads 40 that are wound around the inner core 38, this is giving a radial pressure against the center of the plug of the core 38. This provides an active downhaul of the element, and that the slip segments 22 are drawn in against the center of the plug only after the packing element 2 is drawn down.

With reference to FIG. 9 the anchoring means 3 will now be described. In a front section 19 of the bridge plug 1 is provided a rear inclined surface 20 against which an anchoring pad or slip segment 22 may slide on an inclined surface 21. A number of slip segments 22 are situated around the circumference of the bridge plug 1. In the preferred embodiment of present invention there are three slip segments 22, but it will be understood that a different number also can be used. The slip segments 22 are preferably provided with a friction surface 28 which can be pressed out against and onto the casing 7. Thus the anchoring means 3 will be more effective in holding the bridge plug in its place during pressure load. The slip segments 22 are, at their rear connected to a pivotable joint 23 by a first pin 25. The opposite ends of the joints 23 are connected to a displacement tube 26 by a second pin 24. The front section 19 with rear inclined surface 20 is connected with a package mandrel 13 via a through connection 36. As shown in FIG. 9, the slip segments 22 are anchored against the center of the bridge plug 1 by return springs 27. This implies that the slip segments are in their rest position, and the bridge plug 1 can be freely inserted in and withdrawn from the casing 7.

Figure 10:
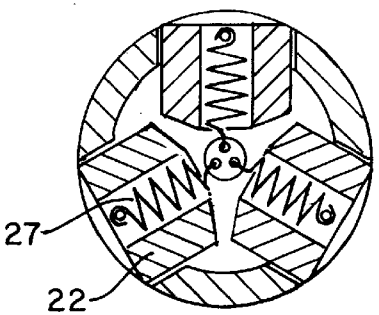
FIG. 10 shows a half section of drawing springs in the slip segments, taken along the line X—X in FIG. 9.
Figure 11:
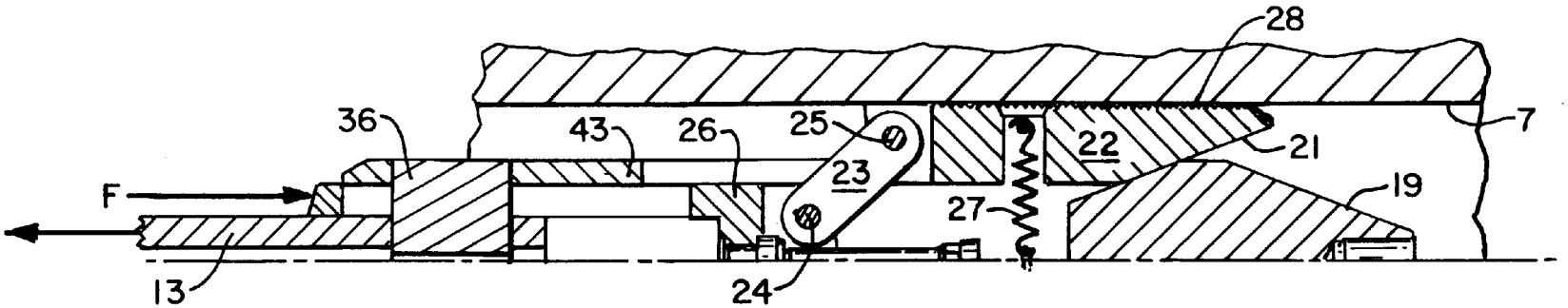
FIG. 11 shows a section as a part projection of the anchoring means from FIG. 9, where the slip segments are pressed onto the casing wall.

FIG. 10 shows a section taken along the line X—X in FIG. 9, illustrating the springs 27 in the slip segments 22. In FIG. 11 the anchoring means 3 is shown in activated condition, with the slip segments 22 pressed against the casing wall 7. When the displacement tube 26 is pressed forward relative to the bridge plug 1 (force F in FIG. 11), the slip segments 22 will be pressed out against the casing wall 7. This outwardly acting force will also counteract the force from the return springs 27. The slip segments 22 will move along the inclined surfaces 20, 21 until the leading edge of the anchorings pads 22 contact against the casing wall. Upon further movement of the displacement tube 26, the rear edge of the anchoring pad 22 will be moved out via joints 23, so that all of the friction surface 28 is pressed in against tube wall 7. Pulling of the bridge plug 1 is done by the displacement tube 26 is withdrawn with a force that is substantially less then the running force F1. This is so because if the support under the inclined surface 21 of the anchoring pad 22 disappears, it will immediately lead to the loosening of the slip segments 22 form the casing wall. Simultanously, the pivotable joint 23 in the rear edge of the anchoring pad will rotate around the pin 24 when the displacement tube 26 is drawn up. This kind of rotation in the joint 23 leads to a radial force against the center of the plug at the rear end of the anchoring pad 22 by the pin 25. Upon a further drawing of the displacement tube 26, the joint 23 will hit an edge 43, which will result in a downward force on the anchoring pad 22. The force of the return springs 27 will also help in drawing the slip segments.

The inclined surface 21 of the slip segments 22, the inclined surface 20 of the bridge plug 1 and the joints 23 limit the expansion of the slip segments. By using the anchoring means 3, without the pivotable joint 23, the slip segments 22 are attached only by one pin 44 and loaded with a return spring 42. With this structure of the anchoring pad 22, as shown in FIG. 12, the length of the stroke can be increased, and a greater expansion rate is achieved.

Figure 12:
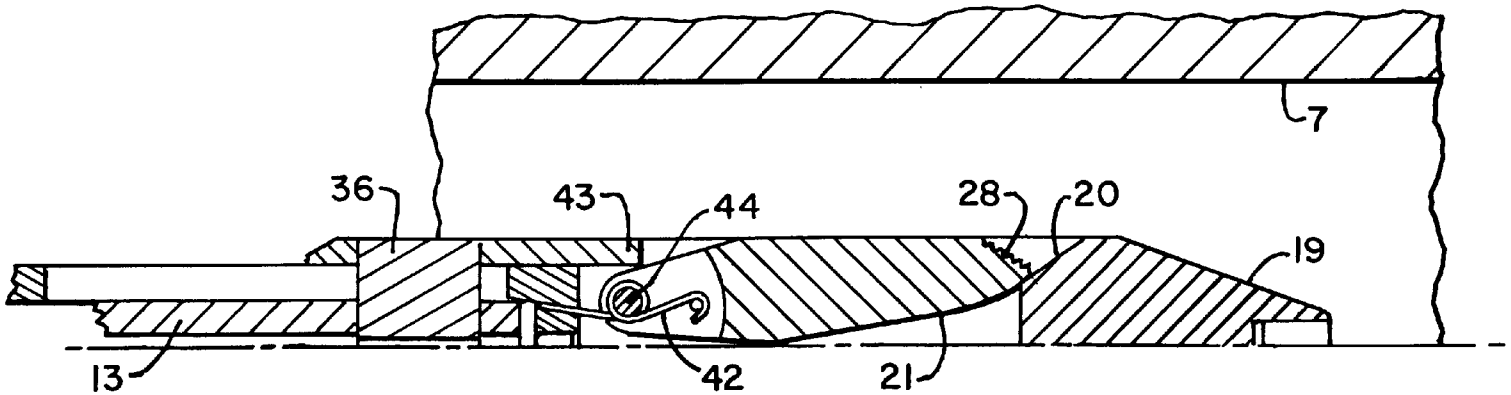
FIG. 12 shows a section as a part projection of a second embodiment of the anchoring means, shown in downdrawn position.
Figure 13:
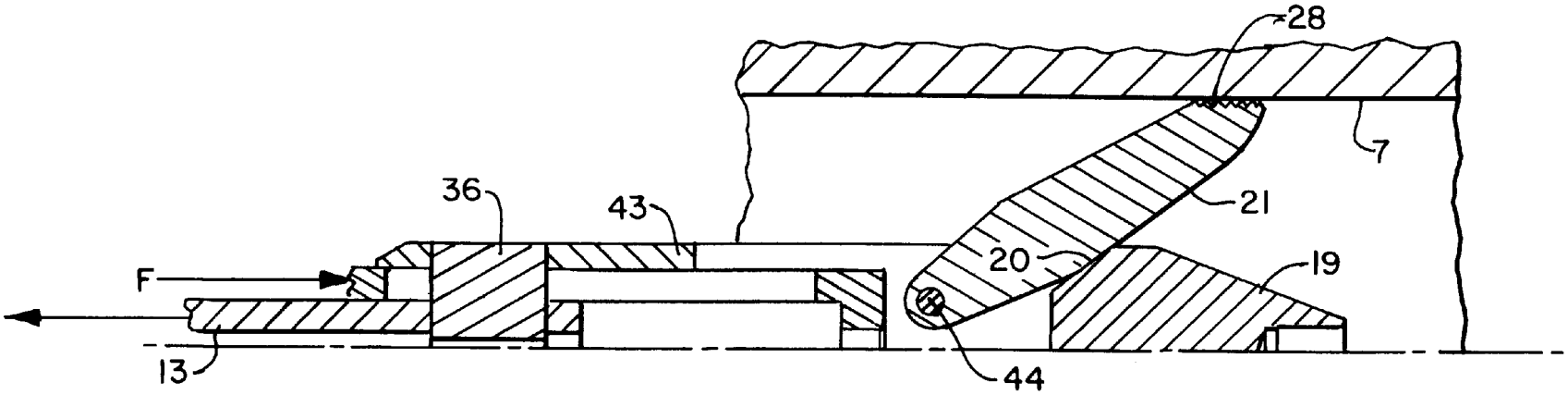
FIG. 13 shows a section as a part projection of the anchoring means of FIG. 12, where the slip segments are pressed onto the casing wall.

FIG. 13 shows the anchoring means 3 from FIG. 12 in expanded state, with the friction surface 28 pressed out against the casing wall 7. Drawing of the anchorings pads 22 is done in the same way as the preferred embodiment, by pulling the displacement tube out relative to the leading edge of the plug. This will lead to the contact between the inclined surfaces 20, 21 to disappear, whereafter the slip segments 22 will hit the edge 43 that lies over the pivoting point 44. The slip segments 22 are thus forced in against the center of the plug 1. The return spring 42 can be situated in the rear edge of the slip segments 22, as shown in FIG. 12, so that the slip segments 22 get an active rotation in against the center of the plug.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A bridge plug for use in a casing, comprising a packing element of a resilient material, where the packing element is adapted for, at impact from a running tool, to expand from a first diameter, to a second diameter that is greater than the first diameter corresponding to an inner diameter of the casing to be sealed, wherein the packing element includes at least one expandable sealing packing element and at least one expandable support packing element where the support packing elements expand to a smaller diameter than the sealing packing elements, and that the bridge plug further comprises an anchoring means that is provided for holding the bridge plug in place in the casing by a friction surface that is pressed radially out against the casing, the packing element having an inner core disposed between two conical packing element clamps, a reinforcement disposed over the inner core, and an outer layer molded to the reinforcement and the core, the inner core being composed of a resilient material and the reinforcement being wound over the inner core and connected to the clamps.

2. The bridge plug according to claim 1, wherein the conical packing element clamps are arranged to move against each other, so that compression is transferred by an axial force through the packing element via the clamps, without the reinforcement being overloaded.

3. The bridge plug according to claim 1, wherein the reinforcement in the packing element is comprised of two or more layers, where the angle between the layers and the compression length are such that the support packing elements and the sealing packing elements are stabilized at a desired diameter.

4. The bridge plug according to claim 1, wherein the support packing element is constructed separately from the sealing packing element, in the form of an expandable steel lamellae or a plastic element.

5. The bridge plug according to claim 1, wherein the anchoring means is comprised of at least two slip segments having a friction surface that is arranged to be pressed out against the casing, wherein a leading, inner inclined surface on the slip segments is arranged for sliding along an outer inclined surface by the leading edge of the bridge plug.

6. The bridge plug according to claim 5, wherein each of the slip segments has a rear edge connected to a pivotable joint by a first pin and that the pivotable joints at the opposite ends are connected to a displacement tube by a second pin, wherein first a leading part of the friction surface engages the casing wall and second the rear edge of the slip segments pivot out via the pivotable joint whereby the friction surface engages the casing wall when the displacement tube is moved further toward the leading edge of the bridge plug.

7. The bridge plug according to claim 6, further comprising an edge disposed adjacent the pivotable joint, wherein the pivotable joint hits the edge and actively draws the slip segments down against the center of the plug when the displacement tube is moved toward the rear edge of the bridge plug.

8. The bridge plug according to claim 5, wherein the slip segments are anchored against the center of the bridge plug by at least a return spring.

9. The bridge plug according to claim 5, further comprising a package mandrel having a circulation port connected to a front section via a through connection is arranged to be released by means of a finger connection from the rest of the bridge plug at drawing thereof, wherein the weight of the released elements help to draw down the packing element and to draw the slip segments down to the center of the plug.

10. The bridge plug according to claim 1, wherein the support packing element is constructed separately from the sealing packing element, in the form of an expandable steel lamellae and a plastic element.

11. The bridge plug according to claim 1, wherein the reinforcement comprises a thread.

12. The bridge plug according to claim 11, wherein the reinforcement thread in the packing element is comprised of two or more layers, where the angle between the layers and the compression length are such that the support packing elements and the sealing packing elements are stabilized at a desired diameter.

13. The bridge plug according to claim 12, wherein the reinforcement thread is provided for at drawing of the plug by a dedicated retrieval tool, to draw in the packing element against the center of the plug, as the reinforcement thread is expanded axially near the clamp.

14. The bridge plug according to claim 1, wherein the support packing element is constructed separately from the sealing packing element, in the form of a rubber element, or expandable steel lamellae or plastic element.

15. The bridge plug according to claim 14, wherein the anchoring means is comprised of at least two slip segments having a friction surface that is arranged to be pressed out against the casing, wherein a leading, inner inclined surface on the slip segments is arranged for sliding along an outer inclined surface by the leading edge of the bridge plug.

16. The bridge plug according to claim 6, wherein the slip segments are anchored against the center of the bridge plug by at least a return spring.

17. The bridge plug according to claim 6, further comprising a package mandrel having a circulation port connected to a front section via a through connection is arranged to be released by means of a finger connection from the rest of the bridge plug at drawing thereof, so that the weight of the released elements help to draw down the packing element and to draw the slip segments down to the center of the plug.

18. The bridge plug according to claim 1, wherein the support packing element is constructed separately from the sealing packing element, in the form of a rubber element, or expandable steel lamellae and plastic element.

* * * * *